US007007415B2

(12) United States Patent
Koch

(10) Patent No.: US 7,007,415 B2
(45) Date of Patent: Mar. 7, 2006

(54) METHOD AND SYSTEM OF CONTROLLING A WORK TOOL

(75) Inventor: Roger D. Koch, Pekin, IL (US)

(73) Assignee: Caterpillar Inc., Peoria, IL (US)

( * ) Notice: Subject to any disclaimer, the term of this patent is extended or adjusted under 35 U.S.C. 154(b) by 66 days.

(21) Appl. No.: 10/738,046

(22) Filed: Dec. 18, 2003

(65) Prior Publication Data

US 2005/0132618 A1 Jun. 23, 2005

(51) Int. Cl.
*G05D 1/10* (2006.01)

(52) U.S. Cl. ..... 37/348; 701/50

(58) Field of Classification Search ..... 37/348; 701/50

See application file for complete search history.

(56) References Cited

U.S. PATENT DOCUMENTS 5,490,081 A 2/1996 Kuromoto et al.
5,701,691 A * 12/1997 Watanabe et al. ..... 37/348
5,704,141 A 1/1998 Miura et al.
5,735,065 A * 4/1998 Yamagata et al. ..... 37/348
5,784,944 A 7/1998 Tozawa et al.
5,957,989 A 9/1999 Egawa et al.
6,032,093 A 2/2000 Denbraber et al.
6,169,948 B1 * 1/2001 Fujishima et al. ..... 701/50
6,230,090 B1 5/2001 Takanashi et al.
6,282,453 B1 8/2001 Lombardi
6,415,604 B1 7/2002 Motomura et al.
6,510,628 B1 1/2003 Koch
6,691,437 B1 * 2/2004 Yost et al. ..... 37/348
6,819,993 B1 * 11/2004 Koch ..... 701/50
6,915,599 B1 * 7/2005 Lohnes et al. ..... 37/348
6,934,616 B1 * 8/2005 Colburn et al. ..... 701/50

* cited by examiner

*Primary Examiner*—Meredith C. Petravick
(74) *Attorney, Agent, or Firm*—Finnegan, Henderson, Farabow, Garrett & Dunner

(57) ABSTRACT

A method for controlling movement of a work tool includes the step of identifying a predefined digging boundary and determining the current position of the work tool. A control signal is generated to change the position of the work tool. A requested motion vector is determined for the work tool based on the control signal. A determined force is generated to apply to the work tool. It is based on the requested motion vector and has a normal component that is scaled to prevent the work tool from crossing the predefined digging boundary. One aspect is directed to a control system for a work tool on a work implement assembly.

22 Claims, 4 Drawing Sheets

METHOD AND SYSTEM OF CONTROLLING A WORK TOOL

TECHNICAL FIELD

This invention relates to a system and method for controlling the movement of a work tool and, more particularly to a system and method for controlling movement of the work tool along a predefined digging boundary.

BACKGROUND

Excavating a work site with a work machine to obtain a desired configuration can often be a complex process. The desired surface configuration may include a boundary surface having, for example, symmetric or non-symmetric walls, floors, ramps, or curves. An operator may control the motion of the work machine to carve out the volume defined by the boundary surfaces. Depending on the nature of the excavation, closely following these boundary surfaces with a work implement assembly of the work machine can be difficult. Accordingly, it takes a skilled operator to be able to successfully and accurately dig out an excavation having such boundary surfaces.

Some work machines have a computer system that is capable of storing the desired boundary surfaces as a predefined digging boundary. The computer system may monitor the position of the work implement assembly and limit the movement of the work implement assembly so that it does not pass through the predefined digging boundary. In so doing, an operator may more easily follow the digging boundary with the work implement assembly, without digging through it.

One work machine capable of limiting the movement of its work implement assembly is described in U.S. Pat. No. 6,415,604 to Motomura et al. This work machine may be programmed to include a height limit position, a reach limit position, and a depth limit position. As the work implement assembly is moved to these limit positions, the valves controlling the work implement assembly are automatically closed to prevent further movement. Accordingly, the work implement assembly cannot extend beyond the established limit positions.

Although useful in ensuring that the work implement assembly does not pass beyond a pre-designated limit, prior art work machines including a control system as described in the '604 patent may reduce the efficiency of the work machine when the work tool is operating near the pre-designated limit. When the work tool approaches the predetermined limit and the valves are closed, the operator may have to generate a new input instruction to continue excavation of the work site. Accordingly, these types of control systems may interrupt the work of the operator and prevent the work tool from moving easily along the limit position or boundary.

The present invention overcomes one or more of the disadvantages of the prior art.

SUMMARY OF THE INVENTION

In one aspect, the present disclosure is directed to a method for controlling movement of a work tool. The method includes the step of identifying a predefined digging boundary and determining the current position of the work tool. A control signal is generated to change the position of the work tool. A requested motion vector is determined for the work tool based on the control signal. A determined force is generated to apply to the work tool. The determined force is based on the requested motion vector and has a normal component that is scaled to prevent the work tool from crossing the predefined digging boundary.

In another aspect, the present disclosure is directed to a control system for a work tool on a work implement assembly. The system includes at least one sensor associated with the work implement assembly and adapted to sense a parameter indicative of the current position of the work tool. An input device is operable to generate a control signal to change the position of the work tool. A control module has a memory adapted to store a predefined digging boundary. The control module is adapted to determine a current position of the work tool, to receive the control signal from the input device, and to determine a requested motion vector for the work tool based on the control signal received from the input device. The control module is further adapted to generate a determined force to apply to the work tool. The determined force is based on the requested motion vector and has a normal component that is scaled to prevent the work tool from crossing the predefined digging boundary.

DETAILED DESCRIPTION

Figure 1:
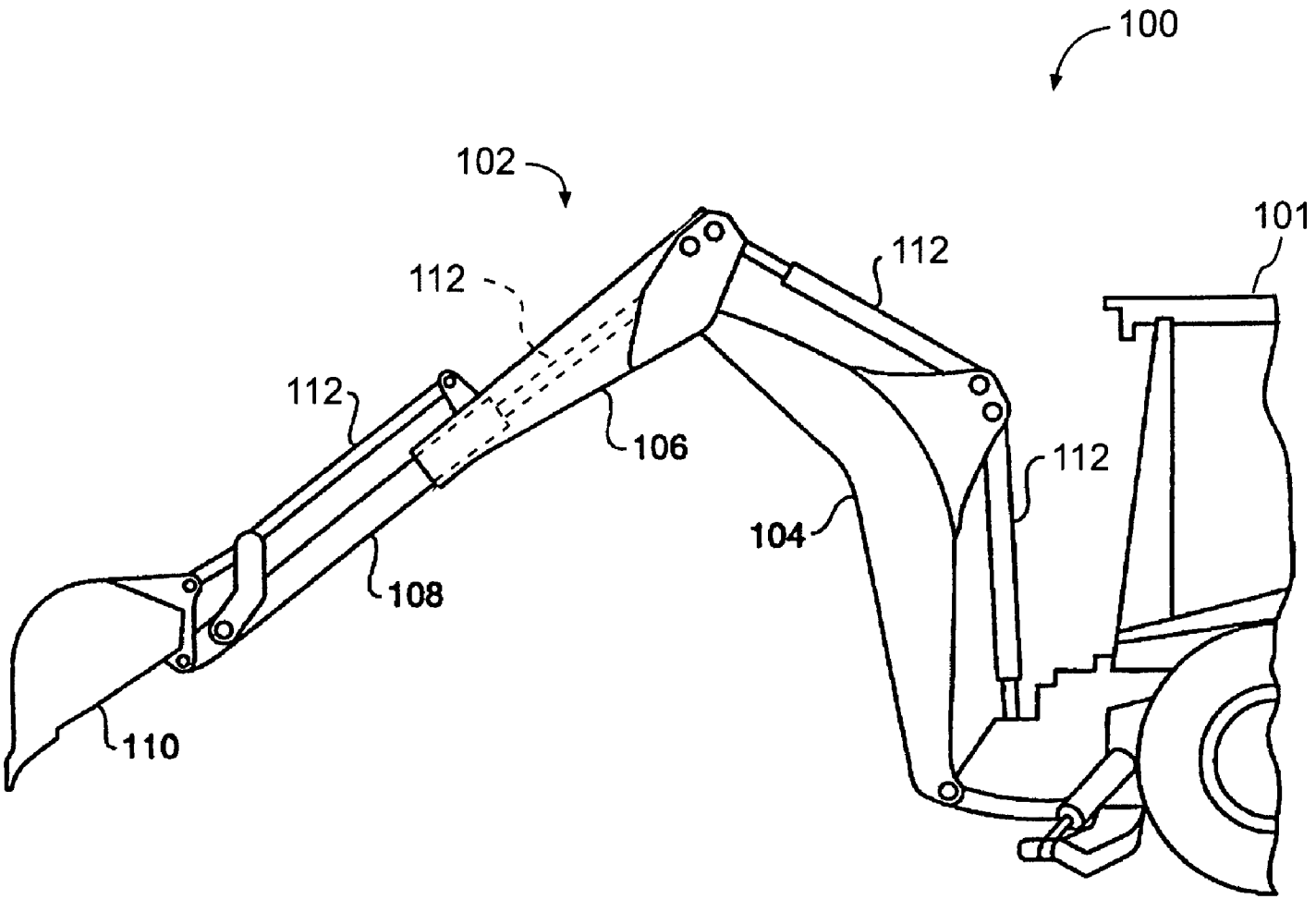
FIG. 1 is a pictorial illustration of a portion of a work machine suited for use with the present invention.

FIG. 1 illustrates an exemplary embodiment of a relevant portion of a work machine 100. The work machine 100 may be used for a wide variety of earth-working and construction applications. Although the work machine 100 is shown as a backhoe loader, it is noted that other types of work machines 100, e.g., excavators, front shovels, material handlers, and the like, may be used with embodiments of the disclosed system.

The work machine 100 includes a body 101 and work implement assembly 102 having a number of components, including, for example, a boom 104, a stick 106, an extendable stick (E-stick) 108, and a work tool 110, all controllably attached to the work machine 100. The boom 104 is pivotally connected to the body 101, the stick 106 is pivotally attached to the boom 104, the E-stick 108 is slidably associated with the stick 106, and the work tool 110 is pivotally attached to the E-stick 108, as is known in the art. The work implement assembly 102 may pivot relative to the body 101 in a substantially horizontal and a substantially vertical direction.

Actuators 112 may be connected between each of the components of the work implement assembly 102. Each of the actuators 112 may be adapted to provide movement between pivotally and/or slidably connected components. The actuators 112 may be, for example, hydraulic cylinders. As is known in the art, the movement of the actuators 112 may be controlled by controlling the rate and direction of fluid flow to the actuators 112.

Figure 2:
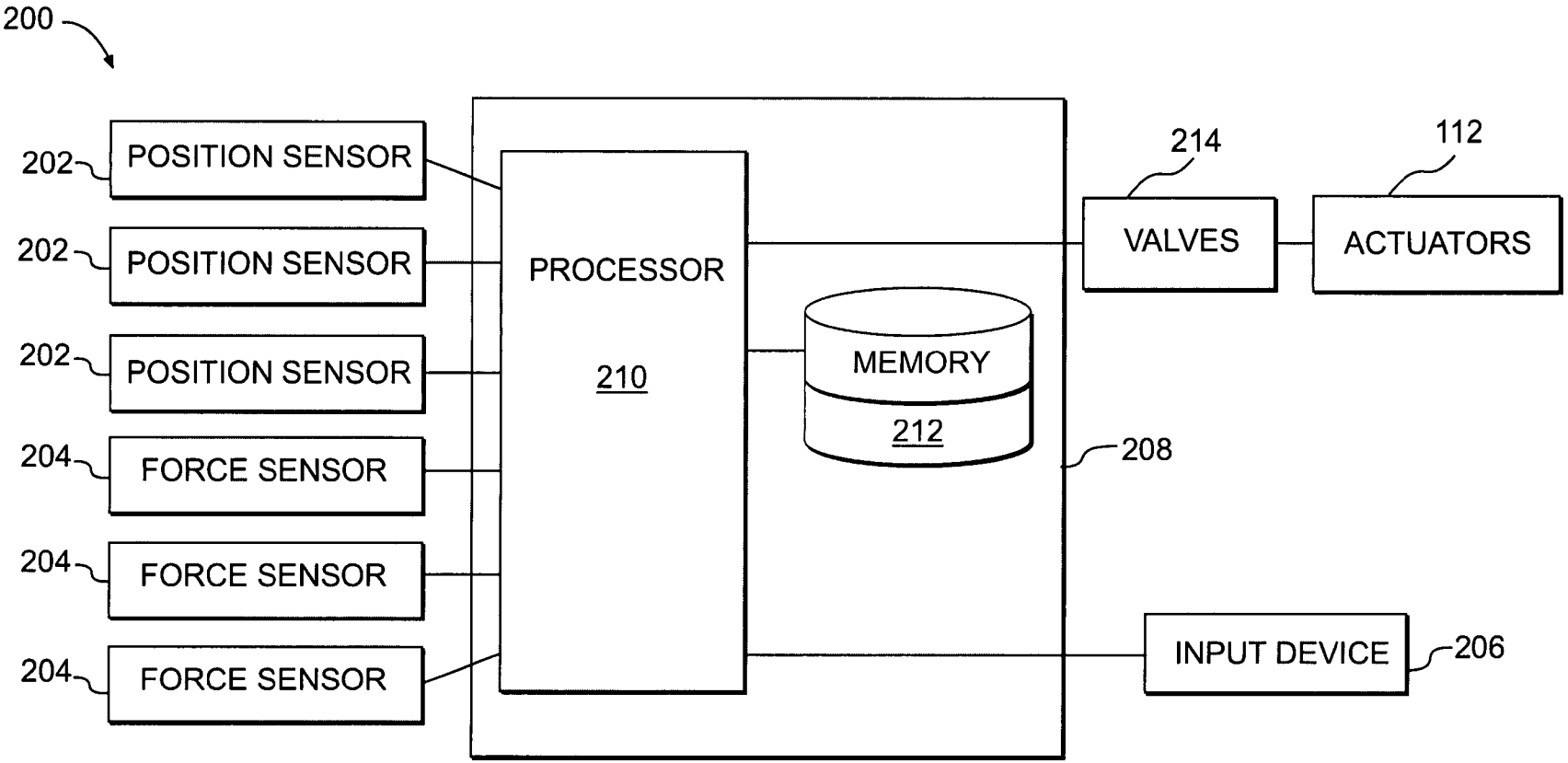
FIG. 2 is a block diagram illustrating an exemplary controller for operating a work implement assembly.

As shown in FIG. 2, hydraulic cylinder valves 214 may be disposed in fluid lines leading to the actuators 112. The valves 214 may be adapted to control the flow of fluid to and from the actuators. The position of the valves 214 may be adjusted to coordinate the flow of fluid to control the rate and direction of movement of the associated actuators 112 and the components of the work implement assembly 102.

FIG. 2 shows an exemplary controller 200 adapted to control movement of the work implement assembly 102. The controller 200 may include one or more position sensors 202, one or more force sensors 204, an input device 206, and a control module 208. The controller 200 may include other components, as would be readily apparent to one skilled in the art.

The position sensors 202 may be configured to sense the movement of the components of the work implement assembly 102. These position sensors 102 may be operatively coupled, for example, to the actuators 112. Alternatively, the position sensors 202 may be operatively coupled to the joints connecting the various components of the work implement assembly 102. These sensors may be, for example, length potentiometers, radio frequency resonance sensors, rotary potentiometers, angle position sensors or the like.

The force sensors 204 may be adapted to measure external loads applied to the work implement assembly 102. In one exemplary embodiment, the force sensors 204 may be pressure sensors for measuring the pressure of fluid within any of the actuators 112. The pressure of the fluid within the actuators 112 may be used to determine the magnitude of the applied loads. In this exemplary embodiment, the force sensors 204 may be comprised of two pressure sensors associated with each actuator 112 with one pressure sensor located at each end of the actuator 112. In another exemplary embodiment, the force sensors 204 may be a single strain gauge load cell in line with each actuator 112. The position sensors 202 and the force sensors 204 may communicate with a signal conditioner (not shown) for conventional signal excitation scaling and filtering. In one exemplary embodiment, each individual position and force sensor 202, 204 may contain a signal conditioner within its sensor housing.

The controller 200 may also include an input device 206, used to input information or operator instruction to control components of the work machine 100, such as the work implement assembly 102. The input device 206 may be used, for example, to generate control signals that represent requested motion of the work implement assembly 102. The input device 206 could be any standard input device known in the art, including, for example, a keyboard, a joy stick, a keypad, a mouse, or the like.

The position sensors 202, the force sensors 204, and the input device 206 may be in electrical communication with the control module 208. The control module 208 may be disposed on the work machine 100 or alternatively, may be remote from the work machine 100 and in communication with the work machine 100 through a remote link.

The control module 208 may contain a processor 210 and a memory 212. The processor may be a microprocessor or other processor, and may be configured to execute computer readable code or computer programming to perform functions, as is known in the art. The memory 212 may be in communication with the processor 210, and may provide storage of computer programs and executable code, including algorithms and data corresponding to known specifications of the work implement assembly 102.

In one exemplary embodiment, the memory 212 is adapted to store a predefined digging boundary. The predefined digging boundary may represent the desired configuration of an excavation site, and may be a planar boundary, or an arbitrarily shaped surface. The predefined digging boundary may be, for example, obtained from blueprints and programmed into the control module 208, created through a graphical interface, or obtained from data generated by a CAD/CAM or similar program.

Further, the memory 212 may be adapted to store a threshold boundary. The threshold boundary may be programmed into the control module 208 to provide a boundary that is offset a designated distance from the predefined digging boundary. As described in greater detail below, the control of the work implement assembly 102 may be varied when the work tool 110 is within the threshold boundary and in close position to the predefined digging boundary.

The control module 208 may be configured to process information obtained by the position sensors 202 and the force sensors 204 to determine the current position of and the current force applied against the work tool 110. It may also be configured to translate the current force into components, including a current normal force and a current parallel force, substantially normal to and parallel to the predefined digging boundary, respectively. The control module 208 may use standard kinematics or inverse kinematics analysis to determine the position of and force on the work tool 110.

The control module 208 may also be adapted to receive and interpret control signals from the input device 206 that request movement of the work implement assembly 102. If the control signals are requests for a rate of motion, the control module 208 may be adapted to convert these rates to distances. Based on these control signals, the control module 208 may determine a requested motion vector for the work implement assembly 102 based on the control signal from the input device 206. Likewise, the control module 208 may be configured to translate the requested motion vector into a requested normal component and a requested parallel component. These components may be, respectively, normal to and parallel to the predefined digging boundary.

In one exemplary embodiment, the control module 208 may scale the requested normal component to generate a modified or scaled normal force against the predefined digging boundary. The magnitude of the requested normal component may be scaled to ensure that the work tool 110 closely follows along the digging boundary. The amount of scaling may be based on the proximity of the digging boundary to the work tool 110, and may be further defined by the control signal from the input device 206. The control module may be adapted to calculate a required normal force that represents the force required to adjust the force on the work tool 110 so that the current normal force, over time, changes to more closely match the scaled normal force.

The control module 208 may be adapted to process information obtained from the sensors 202, 204, the control signal from the input device 206, and the requested motion vector to create a motion request. The motion request may represent the control signal, after processing, that may be sent to the valves 214 to move the actuators 112.

The control module 208 may be adapted to process the control signals differently based on a control signal from the input device 206. For example, the control module 208 may process control signals in a first manner when operating in a coordinated mode and may process the control signals in a different manner when not operating in the coordinated mode. In other words, activating or de-activating the coordinating mode may change the manner in which control signals are processed. In one exemplary embodiment, the coordinated mode may be used to activate and deactivate a scaling feature that scales the requested normal component to generate the scaled normal force. The input device 206 may activate the coordinated mode, or scaling feature, through a signal generated by, for example, a button, a trigger, and/or a slider. In one exemplary embodiment, the coordinated mode is active only so long as a thumb button on the input device 206 is depressed. Programming or executable code controlling the coordinated mode may be stored in the memory 212 and processed by the processor 210.

In one exemplary embodiment, the controller 200 may also include velocity transducers associated with the work implement assembly 102. In this embodiment, the control module 208 may use a velocity kinematics analysis and control the velocity of the components of the work implement assembly 102 to thereby control the movement of the work tool 110.

Figure 3:
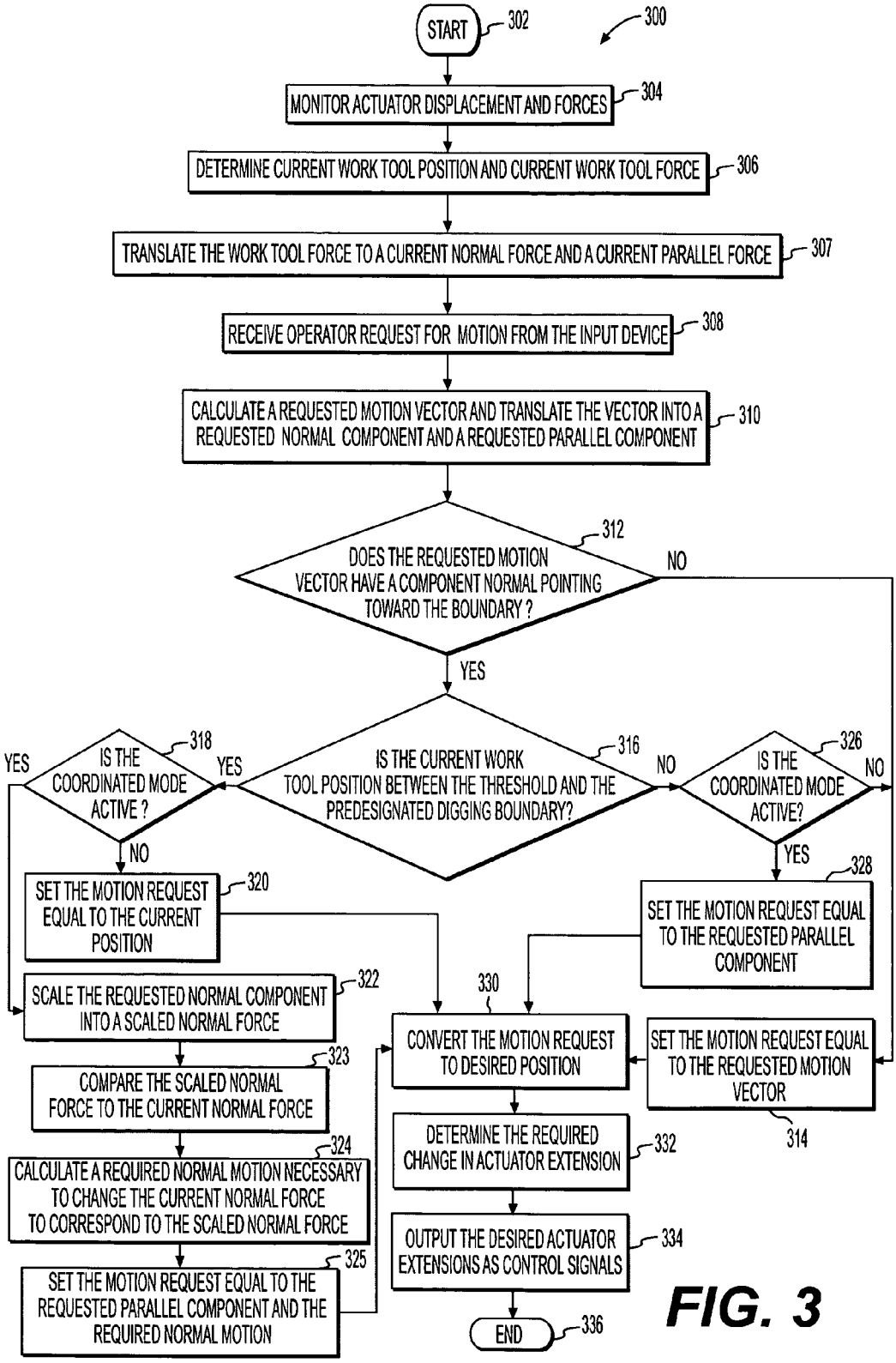
FIG. 3 is a flow chart showing an exemplary method for controlling the work tool of the work machine of FIG. 1.
Figure 4:
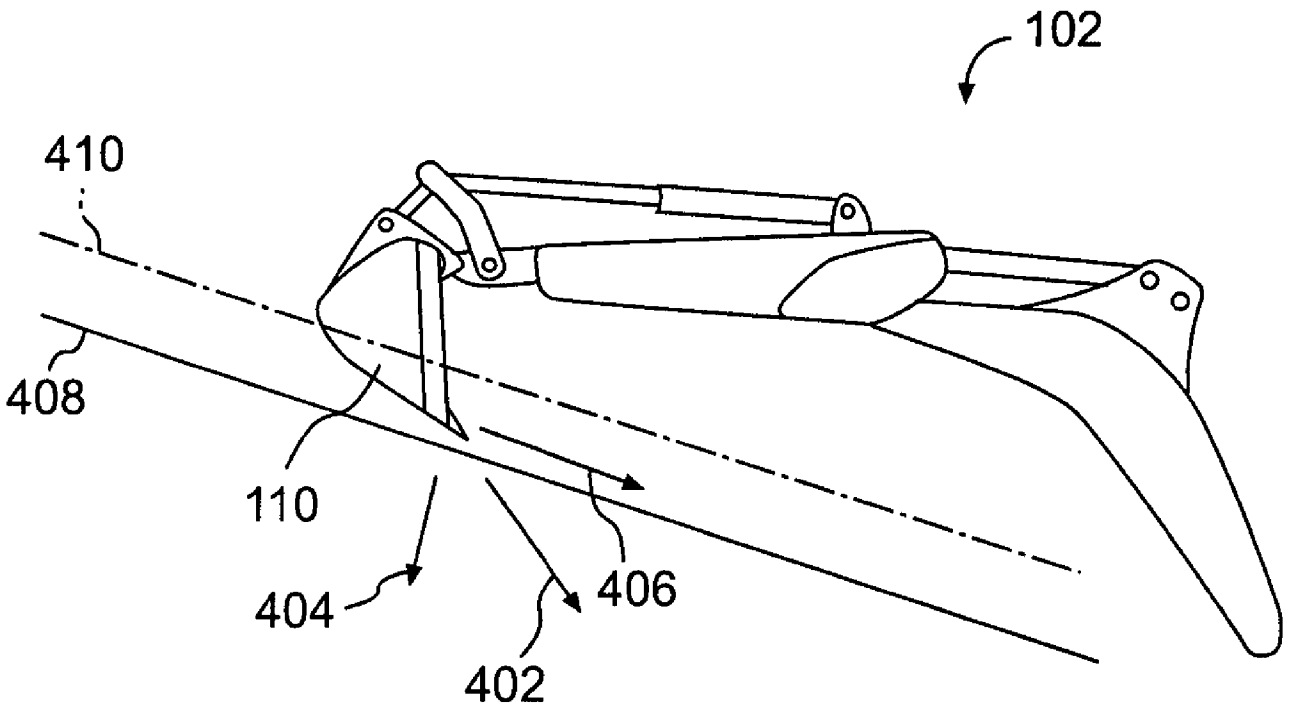
FIG. 4 is a diagrammatic illustration of a work implement assembly moving along a digging boundary.

FIG. 3 illustrates a method for controlling movement of the work implement assembly 102. FIG. 3 shows a flow chart 300 having steps performed by the controller 200. FIG. 4 shows an exemplary embodiment of a work implement assembly 102 moving along a predefined digging boundary.

INDUSTRIAL APPLICABILITY

The following discussion describes the operation and functionality of the above described system for controlling the work tool 110. FIG. 3 shows a flow chart 300 that starts at a step 302. The start step 302 may include storing a predefined digging boundary within the control module 208, along with a boundary threshold, as described above. The start step 302 may also include powering of the work machine 100 or, alternatively, may include switching to a certain operating mode or preprogrammed sequence stored within the memory 212 of the control module 208 on the work machine 100.

At a step 304, the control module 208 monitors the position of the actuators 112 and the forces applied to the work tool 110 using the position sensors 202 and/or the force sensors 204. The sensors 202, 204 electronically communicate with the control module 208, sending signals that represent the measured information. At a step 306, the control module 208 determines the current position of the work tool 110 and the current force applied to the work tool 110, as a current work tool force, based on the signals received from the position sensors 202 and the force sensors 204 and stored geometric and kinematics calculations. At a step 307, the control module translates the current work tool force into a current normal force and a current parallel force relative to the predefined digging boundary. The current normal force is the component of the current work tool force that points normal to the predefined digging boundary, while the current parallel force is the component of the current work tool force that points in the direction parallel to the predefined digging boundary.

At a step 308, an operator of the work machine 100 operates the input device 206 to generate a control signal, which is sent from the input device 206 to the control module 208. The control signal may represent a request for motion of the work implement assembly 102 such as, for example, moving the work implement assembly 102 from its current position to a new position. The input device 206 may be adapted to provide a control signal ranging from no signal to a maximum control signal. The control signal may represent a requested velocity, such as 300 mm/s, which may then be converted by the control module 208 to a change in position, i.e., a small motion that may be accomplished in one computational cycle of the flow chart 300. For example, the request for movement of 300 mm/s may be converted to a request for 3 mm, with a computational cycle time of 0.01 seconds.

At a step 310, the control module 208 calculates a requested motion vector based on the control signal sent from the input device 206. The requested motion vector has a magnitude and direction indicated by the control signal. For example, a small movement of the input device 206 results in a requested motion vector having a small magnitude, while a relatively larger movement of the input device 206 results in a requested motion vector having a relatively larger magnitude. The control module 208 further processes the requested motion vector by translating it into a requested normal component and a requested parallel component, relative to the predefined digging boundary. The requested normal component is the component of the requested motion vector that points normal to the predefined digging boundary, while the requested parallel component is the component of the requested motion vector that points in the direction parallel to the predefined digging boundary.

FIG. 4 illustrates a requested motion vector 402 for movement of the work implement assembly 102 along a predefined digging boundary 408. As stated above, the requested motion vector 402 is generated based upon control signals from the input device 206. The control module 208 processes the requested motion vector 402, translating it into a requested normal component 404 and a requested parallel component 406. A threshold boundary 410 may also be programmed into the control module 208, providing a boundary that is offset a designated distance from the predefined digging boundary 408. This threshold boundary distance may be used to activate alternate controlling of the work implement assembly 102 due to the proximity of the work took 110 to the predefined digging boundary 408. In this manner, the control module 208 may ensure that the work tool 110 does not pass through the digging boundary 408.

Returning to FIG. 3, at a step 312, the control module 208 may determine whether the requested motion vector includes a requested normal component pointing toward the predefined digging boundary. If the requested motion vector does not include a normal component pointing toward the predefined digging boundary, then the requested motion is either parallel to or away from the predefined digging boundary. Because there is no chance that the work tool 110 will pass through the predefined digging boundary, the control module 208 creates a motion request that is equal to the requested motion vector, at a step 314. As stated above, a motion request represents the control signal, after processing, that may be sent to the valves 214 to move the actuators 112. Accordingly, if at step 312 the requested motion vector does not have a component normal to and into the predefined digging boundary, then the motion request sent from the control module 208 to the valve 214 will be equivalent to the requested motion vector.

If at step 312 the requested motion vector includes a requested normal component pointing toward the predefined digging boundary, the control module 208 queries whether the current position of the work tool 110 is between the threshold boundary 410 and the predefined digging boundary 408, at a step 316. As stated above with reference to FIG. 4, the threshold boundary 410 is a boundary parallel to and offset from the predefined digging boundary 408. It may be used to activate alternate controlling of the work implement assembly 102 due to the proximity of the work took 110 to the predefined digging boundary 408.

At step 316, if the current position of the work tool 110 is between the threshold boundary and the predefined digging boundary, then the control module 208 queries at a step 318 whether the coordinated mode is active. As explained above, the coordinated mode may be a mode programmed into the control module 208 for processing the control signal from the input device 206 in a certain manner. In one exemplary embodiment, the coordinated mode may be used to activate and deactivate a scaling feature that scales the requested normal component to generate the scaled normal force. In one exemplary embodiment, the coordinated mode is activated so long as a thumb button on the input device 206 is depressed.

If at step 318, the coordinated mode is not active, then the control module 208 creates a motion request equal to the current position of the work implement assembly 102 at a step 320. Because the motion request is equal to the current position, the motion request does not include a request to move from the current position, and therefore, the work tool 110 will stay at its current position. This may be considered a zero motion request. This enables the control module 208 to ensure that the work tool 110 does not pass beyond the predefined digging boundary.

If at step 318, the coordinated mode is active, the control module 208 may determine a force to be applied to the work tool 110 by scaling the requested normal component of the requested motion vector into a scaled normal force at a step 322, using a normal component scaling factor. The scaled normal force represents a scaled magnitude of force set to correspond to the magnitude of the requested normal component of the requested motion vector. It should be noted that the normal component scaling factor may be a map, a linear, or a non-linear expression, and may be based upon the distance of the work tool 110 from the predefined digging boundary. An example, referred to during the next several steps of the flow chart 300, illustrates the manipulations by the control module 208. In this example, the requested normal component is equal to 3 mm and the normal component scaling factor is 200 lb/mm. Thus, the scaled normal force is equal to 600 lb.

At a step 323, the control module 208 may compare the scaled normal force to the current normal force, that was determined at step 307. This comparison may include finding the difference between the scaled normal force and the current normal force. Following the example, if the current normal force is 100 lb, then comparing the scaled normal force of 600 lb and the current normal force of 100 lb results in difference of 500 lb.

Then, at a step 324, the control module 208 calculates a required normal motion. The required normal motion may represent the amount of motion of the work tool 110 to change the current normal force to correspond to the scaled normal force. It may be based on a motion scaling factor, which may be a map, a linear, or a non-linear expression. Using the example, the required normal motion represents the amount of motion necessary to increase the current normal force by 500 lb, so that it corresponds to the scaled normal force of 600 lb. In this example, the motion scaling factor is 0.001. Accordingly, to increase the current normal force by 500 lb, the control module 208 calculates a required normal motion of 0.5 mm. It should be noted that the motion scale factor used to convert the difference in the scaled normal and the current normal forces is less than the reciprocal of the normal component scaling factor used to convert the requested normal component to the allowable force request, i.e., for the example, $0.001<1/200$. This ensures that the system does not overcorrect, and drive the work tool 100 past the predefined digging boundary. Depending on the current position of the work tool 110, the control module 208 may also apply additional corrective values to ensure that the work tool 110 does not pass through the predefined digging boundary, or, if it has passed through the boundary, returns to the predefined digging boundary. In the event that the scaled normal force is reached before the work tool 110 has moved the distance of the required normal motion, the difference between the current normal and the requested normal forces becomes zero. Thus, no additional normal motion is requested.

At a step 325, the control module creates a motion request equal to the combination of the requested parallel component and the required normal motion. Thus, the motion request increases the current normal force to the scaled normal force.

Returning to step 316, if the current position of the work tool 110 is not between the threshold boundary and the predefined digging boundary, then, at a step 326, the control module 208 queries whether the coordinated mode is active. If at step 326 the coordinated mode is not active, then the control module 208 creates a motion request equal to the requested motion vector at step 314. This is because the work tool 110 may be some considerable distance from the predefined digging boundary, and tight control of the movement of the work tool 110 is not required. Accordingly, the work implement assembly 102 may be completely unrestrained in its movement.

If at step 326 the coordinated mode is active, the control module 208 may create a motion request equal to the requested parallel component at a step 328. Accordingly, at step 328, the requested normal component may be completely cancelled out, leaving only the requested parallel component. Thus, the resulting motion request is a request to move the work tool 110 parallel to the predefined digging boundary.

At step 330, the control module 208 converts the motion request, whether altered or unaltered from the requested motion vector, to a new desired position of the work tool 110. The control module 208 may then convert the desired position of the work tool 110 to provide a required change in extension of the actuators 112 at a step 332. This conversion may be accomplished using reverse kinematics equations. The required change in extension is the change necessary to move the work tool 110 to the desired position. At a step 334, the control module 208 outputs the required change in extension to a closed-loop controller for operating the valves 214 to move the actuators 112. At a step 336, the method ends.

The present method enables an operator of a work machine to easily dig along a predefined digging boundary. Furthermore, the present invention allows the operator to apply a desired normal force to the predefined digging boundary. The normal force allows the operator to pack the ground along the digging boundary or to slide the work tool 110 along the digging boundary depending on the settings of the scaling. Accordingly, the operator can cleanly dig on the digging boundary without going through the digging boundary.

The disclosed system may be used with work tools other than digging tools. For example, the disclosed system may be used when power brushing or compacting a surface, and may be used with work implement assemblies that may not include all the components described in the present disclosure.

Further, although the disclosed system is described with reference to a work machine having a work implement assembly used on a backhoe, the present invention may be used on any work machine configured to dig or excavate along a boundary, including, but not limited to, excavators, backhoes, shovelers, dozers, loaders, and other work machines. Other embodiments will be apparent to those skilled in the art from consideration of this specification and the practice of the system disclosed herein. It is intended that the specification and examples be considered as exemplary only, with a true scope of the disclosure being indicated by the following claims.

What is claimed is:

1. A method for controlling movement of a work tool, comprising:

identifying a predefined digging boundary;

determining a current position of the work tool;

generating a control signal to change the position of the work tool;

determining a requested motion vector for the work tool based on the control signal; and generating a determined force to apply to the work tool, the determined force being based on the requested motion vector and having a normal component that is scaled to prevent the work tool from crossing the predefined digging boundary.

2. The method of claim 1, wherein the magnitude of the normal component of the determined force is reduced to prevent the work tool from crossing the predefined digging boundary.

3. The method of claim 1, further including:

determining a current force on the work tool;

determining the magnitude of a component of the current force that is substantially normal to at least a portion of the predefined digging boundary; and calculating a required motion of the work tool necessary to change the magnitude of the normal component of the current force to correspond to the scaled normal component.

4. The method of claim 1, further including:

determining the magnitude of a component of the requested motion vector that is substantially parallel to at least a portion of the predefined digging boundary; and scaling the magnitude of the normal component of the determined force to zero to allow the work tool to move only in a direction substantially parallel to the at least a portion of the predefined digging boundary.

5. The method of claim 1, further including storing a boundary threshold defining a designated distance from the predefined digging boundary.

6. The method of claim 5, further including determining that the work tool is within the boundary threshold of the predefined digging boundary before scaling the normal component of the requested motion vector.

7. The method of claim 6, further including creating a zero motion request when the scaling feature is not activated, the requested motion vector includes the requested normal component, and the current position of the work tool is between the boundary threshold and the predefined digging boundary.

8. A control system for a work tool on a work implement assembly, comprising:

at least one sensor associated with the work implement assembly and adapted to sense a parameter indicative of the current position of the work tool;

an input device operable to generate a control signal to change the position of the work tool; and a control module having a memory adapted to store a predefined digging boundary, the control module adapted to determine a current position of the work tool, to receive the control signal from the input device, and to determine a requested motion vector for the work tool based on the control signal received from the input device, the control module being further adapted to generate a determined force to apply to the work tool, the determined force being based on the requested motion vector and having a normal component that is scaled to prevent the work tool from crossing the predefined digging boundary.

9. The control system of claim 8, wherein the control module is adapted to reduce the magnitude of the scaled normal component to prevent the work tool from crossing the predefined digging boundary.

10. The control system of claim 8, further including:

at least one sensor associated with the work tool and adapted to sense a parameter indicative of a current force on the work tool;

the control module being further adapted to determine the magnitude of a component of the current force that is substantially normal to at least a portion of the predefined digging boundary, and adapted to calculate a required motion command necessary to change the magnitude of the normal component of the current force to correspond to the scaled normal component of the determined force.

11. The control system of claim 8, wherein the control module is further adapted to scale the magnitude of the normal component of the determined force to zero to allow the work implement to move only in a direction substantially parallel to the predefined digging boundary.

12. The control system of claim 8, wherein the control module is adapted to store a boundary threshold defining a designated distance from the predefined digging boundary.

13. The control system of claim 12, wherein the control module is further adapted to move the work tool in a direction substantially parallel to the predefined digging boundary when the work tool is within the boundary threshold of the predefined digging boundary and the scaled normal component is zero.

14. The control system of claim 13, wherein the control module is adapted to create a zero motion request when the scaling feature is not activated, the requested motion vector includes the requested normal component, and the current position of the work tool is less than the threshold distance from the predefined digging boundary.

15. An apparatus for a work implement assembly having a work tool comprising:

means for determining the current position of the work tool;

means for creating a control signal to change the position of the work tool; and means for generating a determined force to apply to the work tool, the determined force being based on a requested motion vector that is determined from the current position of the work tool and the control signal, the determined force having a normal component that is scaled to prevent the work tool from crossing a predefined digging boundary.

16. The apparatus of claim 15, wherein the generating means reduces the magnitude of the scaled normal component to prevent the work tool from crossing the predefined digging boundary.

17. The apparatus of claim 15, further including:

means for sensing a parameter indicative of a current force on the work tool, and wherein the generating means determines the magnitude of a component of the current force that is substantially normal to at least a portion of the predefined digging boundary, and calculates a required motion command necessary to change the magnitude of the normal component of the current force to correspond to the scaled normal component of the determined force.

18. The apparatus of claim 15, wherein the generating means scales the magnitude of the normal component of the determined force to zero to allow the work tool to move only in a direction substantially parallel to the predefined digging boundary.

19. A work machine, comprising:

a work implement assembly including a work tool and a plurality of hydraulic actuators operatively associated with the work implement assembly;

at least one sensor associated with the work implement assembly and adapted to sense a parameter indicative of the current position of the work tool;

at least one sensor associated with the work implement assembly and adapted to sense a parameter indicative of a current force being exerted on the work tool;

an input device operable to generate a control signal to change the position of the work implement assembly; and a control module having a memory adapted to store a predefined digging boundary, the control module adapted to determine a current position of the work tool, to receive the control signal from the input device, and to determine a requested motion vector for the work tool based on the control signal received from the input device, the control module being further adapted to generate a determined force to apply to the work tool, the determined force being based on the requested motion vector and having a normal component that is scaled to prevent the work tool from crossing the predefined digging boundary.

20. The work machine of claim 19, wherein the control module is adapted to reduce the magnitude of the scaled normal component to prevent the work tool from crossing the predefined digging boundary.

21. The work machine of claim 19, wherein the control module is further adapted to determine the magnitude of a component of the current force that is substantially normal to at least a portion of the predefined digging boundary, and adapted to calculate a required motion command necessary to change the magnitude of the normal component of the current force to correspond to the scaled normal component of the determined force.

22. The work machine of claim 19, wherein the control module is further adapted to scale the magnitude of the normal component of the determined force to zero to allow the work implement to move only in a direction substantially parallel to the predefined digging boundary.

* * * * *